United States Patent [19]

Concepcion

[11] 4,342,287

[45] Aug. 3, 1982

[54] METHOD AND APPARATUS FOR UTILIZING ALCOHOL AS FUEL FOR INTERNAL COMBUSTION ENGINE

[76] Inventor: Jose Ma. R. Concepcion, Manila, Philippines

[21] Appl. No.: 115,616

[22] Filed: Jan. 28, 1980

[51] Int. Cl.[3] ..... F02B 75/12; F02B 25/06

[52] U.S. Cl. ..... 123/1 A; 123/572; 123/575; 123/198 A; 123/25 B

[58] Field of Search ..... 123/1 A. 25 A, 25 B, 123/25 F, 25 E, 25 R, 25 L, 25 N, 25 J, 572, 573, 198 A, 575–578

[56] References Cited

U.S. PATENT DOCUMENTS

| | | | |
|---|---|---|---|
| 2,965,085 | 12/1960 | Kahler | 123/198 A |
| 4,031,864 | 6/1977 | Crothers | 123/1 A |
| 4,078,527 | 3/1978 | Yasuda | 123/25 B |

*Primary Examiner*—Charles J. Myhre
*Assistant Examiner*—E. Rollins Cross
*Attorney, Agent, or Firm*—Keil & Witherspoon

[57] ABSTRACT

This invention broadly relates to a fuel system for an internal combustion engine. More particularly the invention concerns a method and apparatus for utilizing alcohol as fuel for gasoline fed internal combustion engine, wherein the alcohol to gasoline ratio is controlled by a double acting metering device and the alcohol fuel is vaporized using heated positive crankcase ventilation gas.

6 Claims, 3 Drawing Figures

METHOD AND APPARATUS FOR UTILIZING ALCOHOL AS FUEL FOR INTERNAL COMBUSTION ENGINE

This invention broadly relates to fuel system for internal combustion engine. More particularly, the invention concerns a method and apparatus for utilizing alcohol as fuel for gasoline-fed internal combustion engine.

In this invention, an accurate proportion of alcohol from 0% could easily be set to 100% in proportion with gasoline in the gasoline powered vehicle.

This additional gadget for alcohol fuel is to be installed without any engine modification on any gasoline powered vehicle.

The present invention can also effectively run any gas powered vehicle together with alcohol even though the water content of the alcohol exceeds 5%. Unlike alcohol gasoline blends which require anhydrous alcohol having not more than 1% water content.

Furthermore, this system/device can satisfactorily operate the gas powered engine in alcohol proportions exceeding 20% and up to 95% without modifying the engine. Alcohol/gasoline blends require engine modifications when the alcohol proportions exceeds 20% in proportion to gasoline.

The present invention also serves as an effective anti-pollutions device because oil/air vapors from the positive crankcase ventilation (PCV) is first preheated before being mixed with the alcohol fuel contained in the vaporizer unit such that the vapors and the combustible mixture is effectively vaporized and burnt. This method causes a rapid expansion of alcohol vapors. Furthermore, the present invention also make use of an effective metering device which regulate the desired proportion of gasoline and alcohol to be used in the engine.

An object then of the invention is to provide a method and apparatus for utilizing alcohol as fuel in a gasoline powered internal combustion engine whereby any desired proportion of alcohol with gasoline or alcohol alone could be used to run engine.

Yet another object of the invention is to provide a method and apparatus for utilizing alcohol as fuel in gasoline-fed engine wherein alcohol combining with superheated air from the PCV in a vaporizer unit is converted into vaporized form before mixing with gasoline/air mixture in the intake manifold.

Another object of the invention is to provide a method and apparatus of utilizing alcohol as fuel in gasoline-fed engine having a metering device which proportionately regulate the desired amount of alcohol and gasoline fuel needed in the engine.

These and other objects and advantages of the invention will be fully understood upon a reading of the following detailed description and referring to the accompanying drawings forming a material part of this disclosure.

Figure 1:
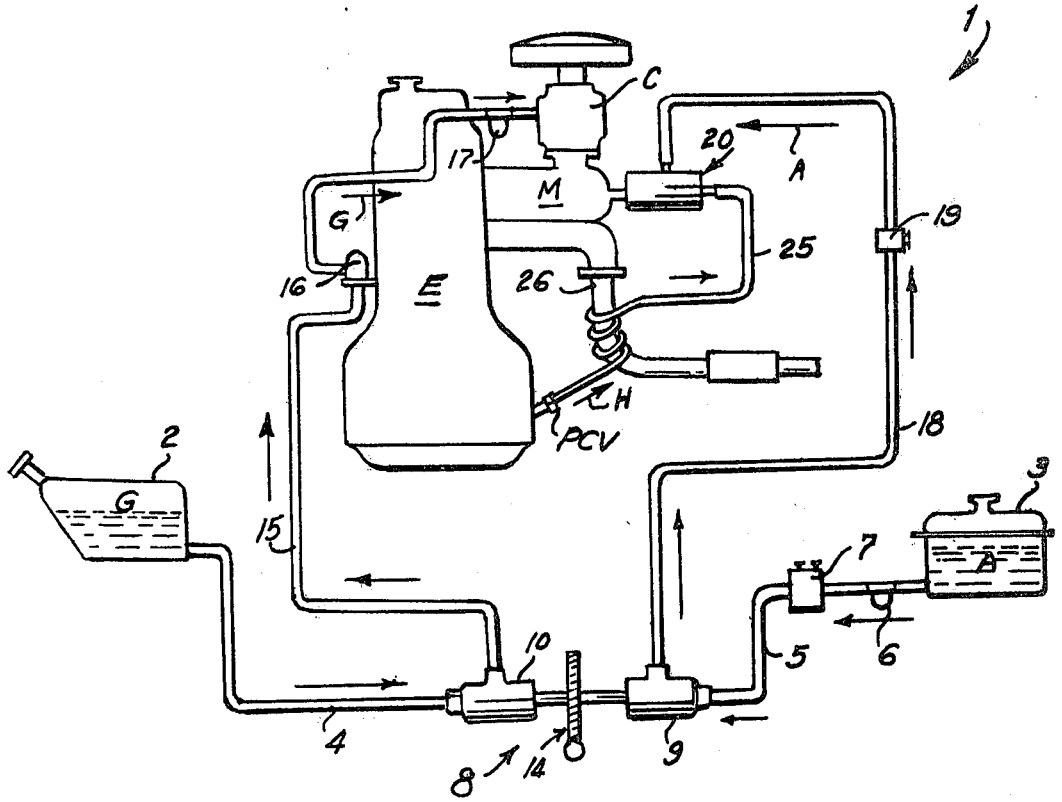
FIG. 1 is an schematic diagram showing the method and apparatus for utilizing alcohol with gasoline fuel in a gasoline-fed internal combustion engine.

Now referring to the drawing, particularly in FIG. 1, there is illustrated a method and apparatus for utilizing alcohol with gasoline fuel as fuel for gasoline-powered internal combustion engine generally designated as 1. As shown, the assembled system for utilizing alcohol includes a separate gasoline and alcohol fuel tank 2 and 3, respectively. Withdrawal of the gasoline G and alcohol fuel A contained in said tank 2 and 3 is maintained by a gasoline and alcohol fuel line 4 and 5, respectively, with the alcohol fuel A conveyed thru a filtering unit 6 and electric fuel pump 7.

From the gasoline fuel line 4 and alcohol fuel line 5, the gasoline G and the filtered alcohol A are separately conveyed to a variable metering device 8 where a desired proportion of alcohol A and gasoline fuel G are accurately regulated.

Figure 3:
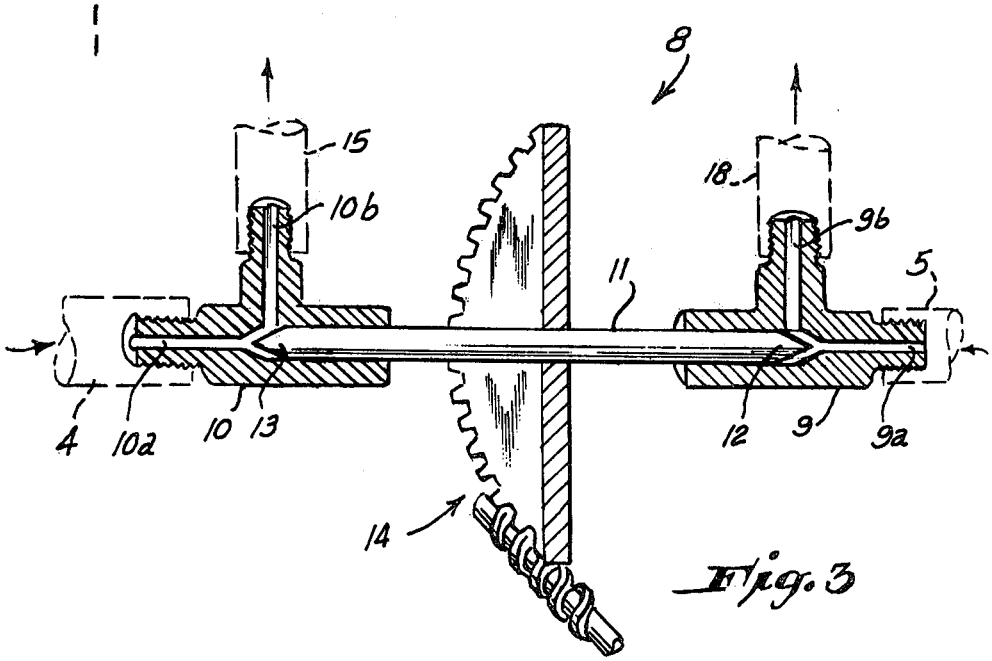
FIG. 3 is a centrally longitudinal cross-sectional view of the metering device utilized in the invention.

As shown in FIG. 3, this metering device 8 is double-acting and essentially consists of a pair of spacedly disposed flow rate valve 9 and 10, each having an angularly disposed fuel inlet **9*a* and 10*a* and outlet 9*b* and 10*b*, respectively. Controlling the flow of fuel in this pair of valve 9 and 10 is a single regulator shaft 11 having an opposed needle valve 12 and 13 at the opposed terminal end thereof. Centrally connected transversely and integrally of this shaft 11 is a driving worm gear 14 which, when turned clockwise or counter-clockwise, a desired alcohol-gasoline proportion is accurately regulated. With this device 8**, either alcohol or gasoline or both fuels could be used in the engine.

From the metering device 8, gasoline fuel G is conventionally conveyed directly to the carburator C of the engine E thru a gasoline fuel outlet line 15 connected communicably with outlet **10*b* of gasoline flow rate valve 10. Conventionally, gasoline fuel G from this outlet line 15 is pumped by a stock mechanical pump 16 and then filtered on a filtering unit 17 prior to its introduction in the carburetor C. Simultaneously but separately with gasoline fuel G, alcohol fuel A passing the flow rate valve 9 is conveyed thru a gasoline fuel outlet line 18 communicably connected on outlet 9*b* of said valve 9 passing a solenoid valve 19 and to a vaporizer unit 20**.

Figure 2:
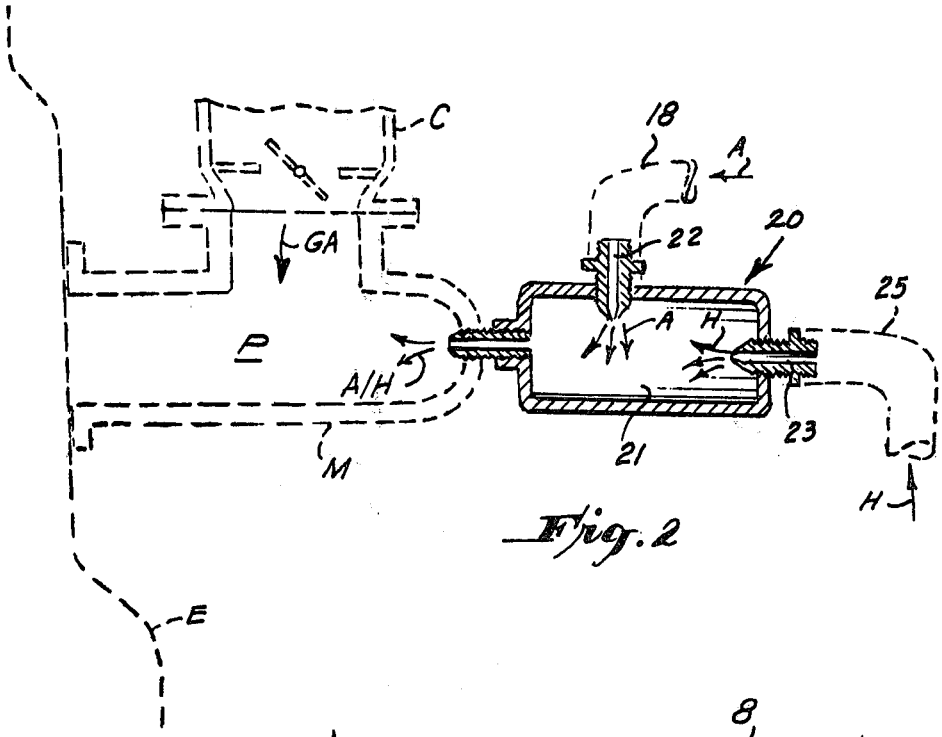
FIG. 2 is a centrally vertical cross-sectional view of a vaporizer unit embodied in the invention.

As shown in FIG. 2, the vaporizer unit 20 is a cylindrical tube detachably connected in communication with the intake manifold M of the engine E. This vaporizer unit 20 has vaporizing chamber 21 having on one side a transverse nozzle alcohol fuel inlet 22 in communication with the alcohol fuel outlet line 18, a nozzle hot air inlet 23 disposed on one end and on the other end a vaporized fuel outlet 24 detachably secured in communication with the intake manifold M.

Simultaneously with the alcohol fuel A entering the vaporizer 20, hot air H emanating from the positive crankcase ventilation PCV is introduced to the said vaporizer 20 by way of an air line 25 being coiled around the engine exhaust pipe 26 acting as heat exchanger. This air line 25 is connected to the hot air nozzle inlet 22 of the vaporizer 18.

In operation, superheated or hot air H from the PCV contains oil vapors expand and hit the alcohol fuel A being sprayed thru the nozzle 22. This sprayed alcohol A rapidly absorbs heat from the said superheated air H thereby converting alcohol in vaporized form, and at the same time making the mixture more combustible. The alcohol/superheated air mixture A/H proceeds to the plenum chamber P of the intake manifold M where it combines with the gasoline fuel air mixture GA from the carburetor C prior to the introduction into the combustion chamber of the engine E.

I claim:

1. A method for feeding alcohol and gasoline fuels to an internal combustion engine wherein the alcohol to gasoline ratio is controlled by a double acting metering device and the alcohol fuel is vaporized using heated positive crankcase ventilation gas, which comprises:

(a) withdrawing alcohol and gasoline fuels from separate fuel tanks through separate fuel lines;

(b) conveying the alcohol fuel using a liquid conveying means to a vaporizing means;

(c) conveying the gasoline fuel using a liquid conveying means to a carburetor means;

(d) controlling the alcohol to gasoline ratio using a double acting metering means;

(e) conveying engine positive crankcase ventilation gas to the vaporizing means through a conduit means by force of crankcase pressure;

(f) heating the engine positive crankcase ventilation gas with engine exhaust gas heat using a heat exchange means through which said conduit passes;

(g) simultaneously introducing the alcohol fuel and the heated positive crankcase ventilation gas into the vaporizing means;

(h) vaporizing the alcohol fuel in the vaporizing means by contact with the heated positive crankcase ventilation gas;

(i) introducing the gasoline fuel into an engine intake manifold through the carburetor means;

(j) conveying the vaporized alcohol fuel and the positive crankcase ventilation gas from the vaporizing means and introducing said alcohol fuel and positive crankcase ventilation gas into the engine intake manifold by pressure means.

2. Apparatus for feeding alcohol and gasoline fuels to an internal combustion engine, which comprises:

(a) a liquid alcohol fuel tank;

(b) a liquid alcohol fuel line;

(c) a liquid alcohol conveying means;

(d) a liquid alcohol vaporizing means;

(e) a gasoline fuel tank;

(f) a gasoline fuel line;

(g) a gasoline conveying means;

(h) a carburetor means;

(i) a double acting flow metering means;

(j) a positive crankcase ventilation gas conduit means and;

(k) a positive crankcase ventilation gas heating means;

whereby the liquid alcohol fuel and gasoline fuel are conveyed separately from their respective fuel tanks to an intake manifold on the internal combustion engine, the gasoline being introduced through the conventional carburetor means and the alcohol fuel being introduced as a vapor from the vaporizing means, and the ratio of alcohol to gasoline being controlled by the double acting metering means by which any change in flow rate of one fuel proportionately and inversely changes the flow rate of the other fuel; the alcohol fuel having been vaporized in the liquid alcohol vaporizing means by direct contact with heated positive crankcase ventilation gas, said gas having been heated in the heating means using heat from engine exhaust gas.

3. The apparatus of claim 2 wherein said vaporizing means comprises a closed chamber having an opening therein to accomodate a nozzle communicating with said liquid alcohol fuel line, an opening at one end thereof to accomodate a nozzle communicating with the positive crankcase ventilation gas conduit means, and an opening in the opposite end thereof, which communicates with the intake manifold on the internal combustion engine.

4. The apparatus of claim 2 wherein said double acting flow metering means comprises:

(a) a pair of spacially disposed flow rate valves, one intersecting the gasoline fuel line and the other intersecting the alcohol fuel line, each valve communicating with said lines through orifices therein;

(b) a single common regulator shaft, formed to comprise the valve stems in the flow rate valves, having opposed needle valves at the opposed terminal ends thereof, each needle valve formed to fit the respective flow rate valve's seat;

(c) a worm gear drive means integral with the regulator shaft by which the regulator shaft is moved in the direction of its axis, opening one valve while closing the other, to alter the ratio of alcohol to gasoline fuel being fed to the engine.

5. The apparatus of claim 2 wherein the flow of alcohol in said alcohol fuel line is further regulated by a solenoid valve.

6. The apparatus in claim 2 wherein the flow of alcohol from said alcohol tank is constantly forced by an electric pump means.

* * * * *